United States Patent [19]

Bourne

[11] 4,189,299

[45] Feb. 19, 1980

[54] DIRECT COOLER FOR CALCINING APPARATUS

[75] Inventor: Percy V. Bourne, Scarborough, Canada

[73] Assignee: Calcimatic International, Limited, Cayman Islands, United Kingdom

[21] Appl. No.: 885,874

[22] Filed: Mar. 13, 1978

[51] Int. Cl.[2] ..... F27D 15/02

[52] U.S. Cl. ..... 432/78; 34/13; 34/20

[58] Field of Search ..... 34/13, 20, 79; 432/78, 432/79

[56] References Cited

U.S. PATENT DOCUMENTS

| | | | |
|---|---|---|---|
| 2,581,409 | 1/1952 | Harlow | 34/20 |
| 2,799,354 | 7/1957 | Borey | 34/79 X |
| 3,345,052 | 10/1967 | Hall | 432/1 X |

*Primary Examiner*—John J. Camby

*Attorney, Agent, or Firm*—Shenier & O'Connor

[57] ABSTRACT

A process of and apparatus for cooling lime produced by calcining limestone and separating the lime dust from the heated air resulting from such cooling in which dust separators are placed inside and near the top of a cooling tower into which the hot lime is dumped. Cool air is drawn into the cooling tower near its bottom, flows up through falling lime and is then pulled into dust separators near the top of the tower. The lime dust caught by the separators falls down through tubes into a chute along with the rest of the lime which has cooled in the tower, and the heated air which comes out of the separator is piped out of the tower for use in the calcining process.

10 Claims, 5 Drawing Figures

14
64
40
62
60
64
62
40
60
36
31
24
36
31
20
30
30
33
33
27
29
28
23
28
22
21
50
22
50
25
26
50

DIRECT COOLER FOR CALCINING APPARATUS

BACKGROUND OF THE INVENTION

My invention relates to an improved method of and apparatus for calcining limestone and, more particularly, to a more efficient method of and apparatus for removing lime dust from air that has been used to cool hot lime produced in the calcining process.

As is known in the prior art, limestone, which is largely calcium carbonate, is reduced to lime or calcium oxide by subjecting the limestone to a high heat for a predetermined period of time. The resulting lime has a wide variety of uses. For example, it is used in the production of steel.

Limestone is heated to very high temperatures of over 1600° F. in the calcining process. When lime is removed from the hearth at such high temperatures it is beneficial to remove much of the heat from it so that it may be more safely and conveniently moved and stored and so that its heat may be fed back into the calcining process, thus reducing fuel costs and thermal pollution.

In the prior art, as shown and described in U.S. Pat. No. 3,345,052, issued to Hubert L. Hall, hot lime which has been removed from a calcining hearth passes down a chute into a cooling chamber. A conduit connects the cooling chamber to external dust separators. A fan pulls cool air into the cooling chamber, where it is heated by contact with the hot lime and then through an external conduit to the external dust separators. Then the fan feeds the resultant heated and cleaned air into ducts leading to the burners used to provide heat for the calcining process.

One problem with the arrangement described above is that an excess of heat is lost by the use of an external duct between the cooling chamber and the dust separators and by the use of external dust separators themselves. Another inefficiency in the use of external dust separators is that lime dust is deposited in the external conduit leading from the cooling chamber to the external dust separators as well as at the site of the external dust separators themselves. It would be desirable if all this lime dust could be deposited under the cooling chamber where the rest of the lime is collected.

SUMMARY OF THE INVENTION

One object of my invention is to provide a method of calcining limestone which overcomes the defects of the calcining systems of the prior art.

Another object of my invention is to provide a method of and apparatus for cooling hot lime produced in the calcining process which recycle a higher percent of the lime's heat back into the calcining process than do arrangements of the prior art.

Another object of my invention is to provide a method of and apparatus for separating lime dust from the air used to cool hot lime which does away with the need to clean lime dust from the conduit used in the prior art to lead from the cooling chamber to external dust separators and which will eliminate the expense and difficulty of bringing lime dust collected by dust separators together with the lime that has passed through the cooling tower and is ready for use.

Other and further objects of my invention will appear from the following description.

In general my invention contemplates the provision of a method of and apparatus for cooling lime produced by calcining limestone in which hot lime removed from a rotary calcinating hearth is dropped into a cooling tower. Cool air is pulled up from the bottom of the tower through the falling lime, from which the air takes heat. The heated air is then drawn through dust separators which are built into the top of the cooling tower so that lime dust can be separated and recovered before the heated air is fed back into the calcining process. I place the dust separators inside and near the top of the cooling tower, so as to minimize heat loss, so as to eliminate the need for a duct from the cooling tower to external dust separators in which lime dust could settle, and so as to make more convenient the combining of the lime dust collected by the dust separators with the rest of the lime which has passed through the cooling tower.

BRIEF DESCRIPTION OF THE DRAWINGS

In the accompanying drawings which form part of the instant specification and which are to be read in conjunction therewith and in which like reference numberals are used to indicate like parts in the various views.

DESCRIPTION OF THE PREFERRED EMBODIMENT

Figure 1:
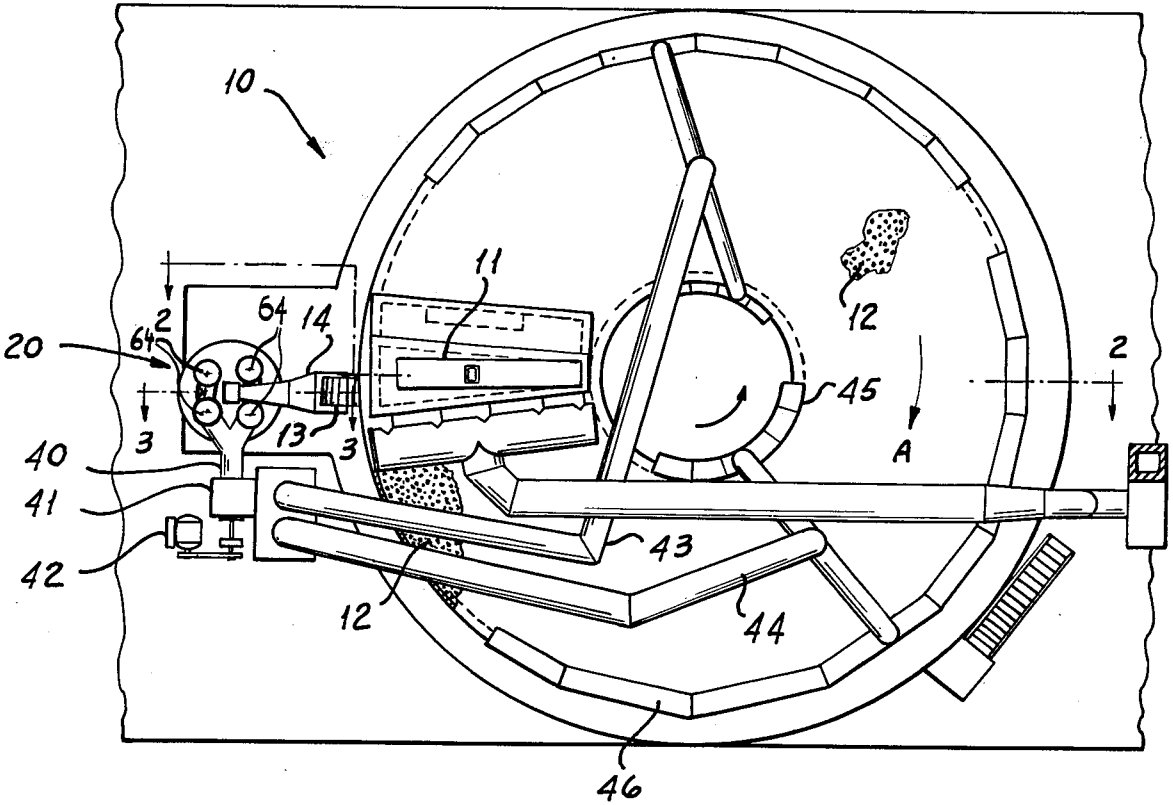
FIG. 1 is a top plan view of an apparatus for calcining limestone, including the cooling tower, with parts broken away.
Figure 2:
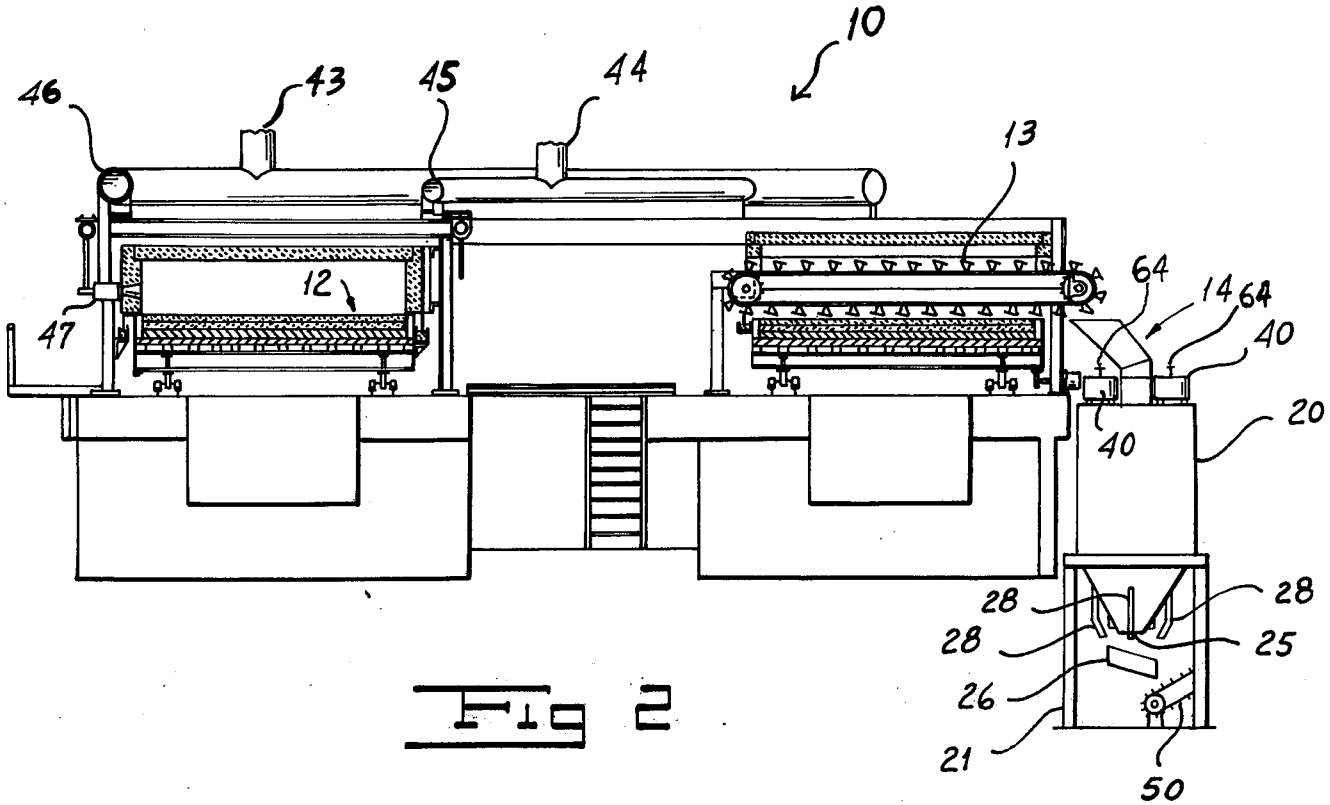
FIG. 2 is a sectional view of the form of my apparatus shown in FIG. 1 taken along the line 2—2 of FIG. 1 with parts removed for clarity in exposition, showing an external view of the cooling tower.
Figure 3:
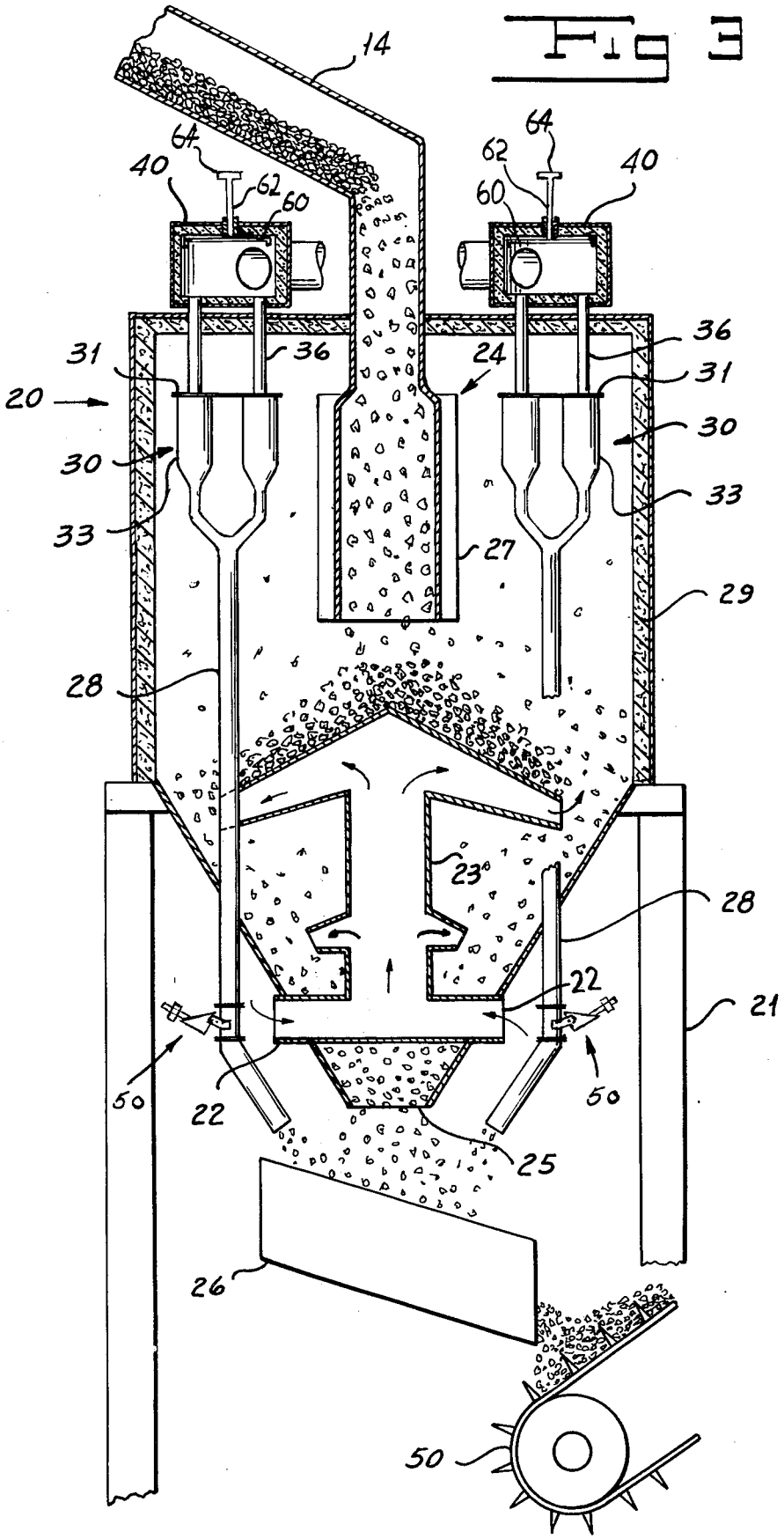
FIG. 3 is a sectional view of the cooling tower taken along the line 3—3 of FIG. 1 with parts removed for clarity in exposition.

Referring now to the drawings, my apparatus for the improved direct cooling of hot lime after its removal from a calcinating hearth includes a cooling tower 20 with dust separators 30 built inside and near the top of said cooling tower. This cooling tower is shown as part of a calcining apparatus 10. The calcining apparatus shown in FIGS. 1 and 2 differs from that shown and described in detail in U.S. Pat. No. 3,345,052, entitled "Method and Means of Calcining Limestone", issued to Hubert L. Hall, only in the configuration of the cooling tower, dust separators and connecting ducts.

In such a calcining apparatus crushed limestone is fed into a tower 11 in which it is preheated and then delivered to a large ring-shaped hearth 12. The hearth rotates in the direction marked by the arrow A in FIG. 1, taking the limestone placed on its surface through various heated zones until the limestone has been sufficiently heated to convert it into lime, at which point the lime is scraped off the hearth by a conveyor 13 which delivers the lime to a chute 14 which directs it into the top of the cooling tower 20 supported on a frame 21.

Referring now to FIGS. 1 to 4, cooling air is drawn into the cooling tower through openings 22 and is guided through air distribution ducts 23, as indicated by arrows, out into the pathway of the falling lime, causing a direct heat exchange between the falling lime and the rising air. The heated cooling air is then pulled upward and through dust separators 30 which are built into the cooling tower adjacent to its top. After the lime dust has been separated from the heated cooling air, the cooling air is pulled out of the top of the cooling tower through the outlet tubes 36 of the dust separators into ducts 40 which lead to a fan 41 driven by a motor 42 which feeds the heated air through distribution ducts 43 and 44, which in turn supply the preheated air to lines 45 and 46 for use by the burners 47 which heat the calcining hearth.

When the heated lime first enters the cooling tower 20 it falls through the top portion of the tower surrounded by a hood, indicated generally by reference character 24, which prevents it from mixing with the cooling air until it is below the level of the dust separators 30. This places the zone in which the lime mixes with the cooling air sufficiently below the dust separators so that most of the lime particles will have had a chance to settle out of the cooling air before it reaches the dust separators, aiding in the dust separation process. The lime particles which do settle out of the cooling air before they reach the dust separators will fall down along with the majority of the lime through the cooling tower, and through the opening 25 in the bottom of the cooling tower into a chute 26. It will be appreciated that this action of my apparatus avoids clogging a conduit pipe as might occur in a system of the prior art in which the cooling air has to travel through such a conduit to external dust separators. The hood 24 in which the lime particles fall through the top portion of the cooling tower is made of heat conducting material and is provided with fins 27 to facilitate indirect heat exchange between lime and cooling air in the top portion of the cooling tower.

Figure 4:
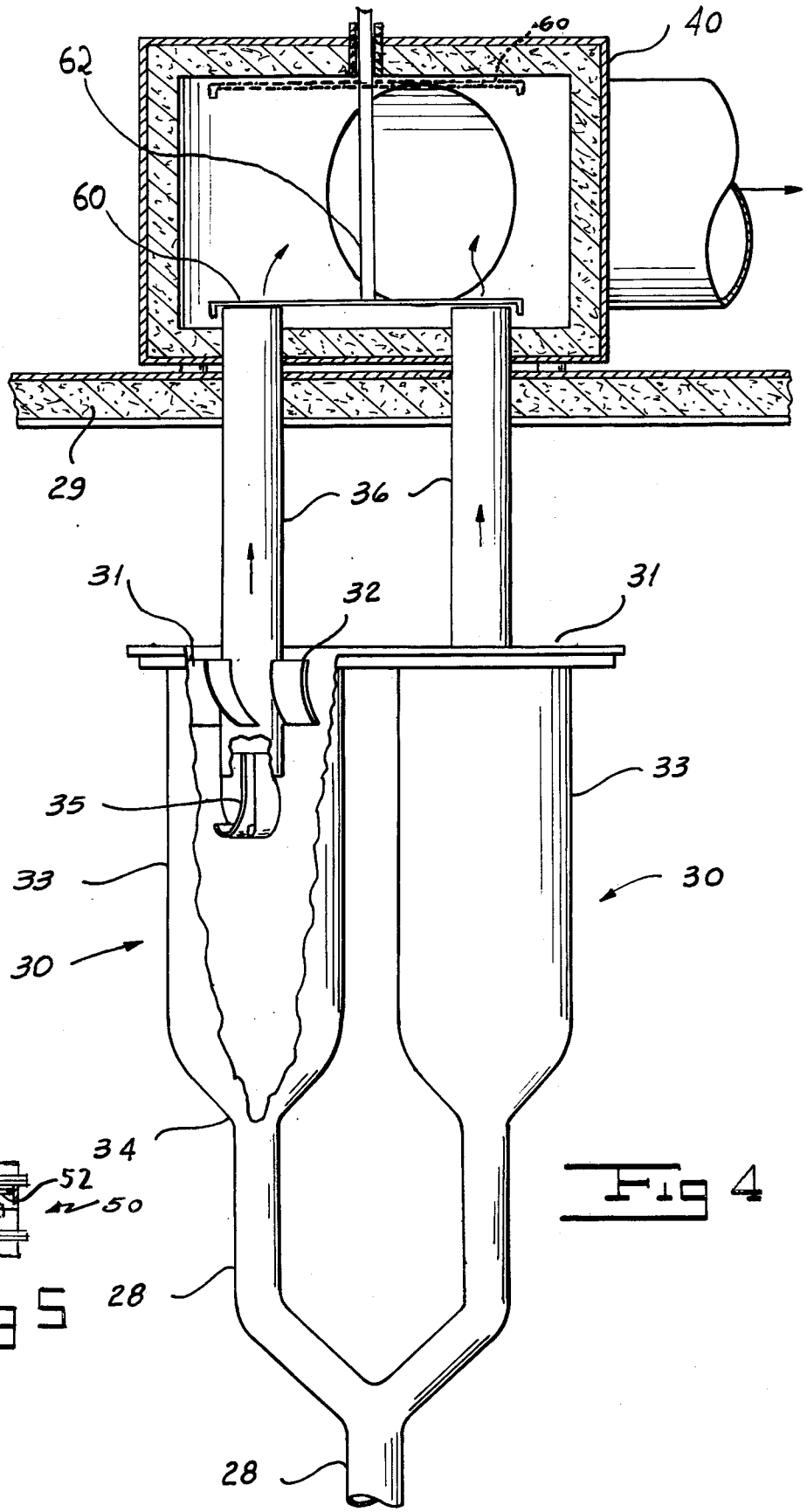
FIG. 4 is a more detailed view of the dust separators located near the top of the cooling tower shown in FIG. 3, with parts broken away and with other parts removed for clarity in exposition.
Figure 5:
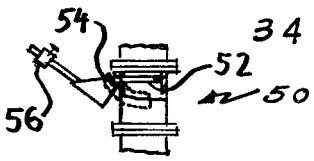
FIG. 5 is a more detailed view of a dust valve located near the bottom of the cooling tower shown in FIG. 3, with parts broken away or shown in dotted lines for clarity in exposition.

The preferred embodiment of my invention includes cyclone dust separators, although I might employ other types of dust separators. As FIG. 4 shows, air entering a cyclone dust separator 30 through its entrance 31, passes through a ring of vanes 32 which gives the air of rotational component of motion within the inlet tube 33 of the dust separator. The resulting centrifugal force causes lime dust particles to be forced outward against the inside surface of the inlet tube 33 where the lime dust collects and falls down through the bottom 34 of the inlet tube 33. Most of the swirling air inside the dust separator is caught by recovery vanes 35 which direct the air to the outlet tube 36 of the dust collector. The lime dust which is separated from the cooling air by this method is allowed to fall out of the bottom 34 of the inlet tube into tubing 28. Tubing 28 contains dust valves 50, each of which consists of a flapper 52, counterbalance 56, and pivot 54 between the two. Normally, the weight of counterbalance 56 pulls down on one side of pivot 54, causing flapper 52 to be extended across tubing 28 so as to prevent air which enters its associated dust separator from being blown out of such tubing. But when the weight of the lime dust which has fallen out of the bottom 34 of a dust separator onto a flapper 52 exceeds the force of its associated counterbalance, the flapper will tilt downward, allowing dust to fall all the way down tubing 28 which leads to chute 26 at the bottom of the cooling tower, where such lime dust joins the other lime which has passed through the cooling tower and is carried away by a conveyor 50.

The ducts 40 contain dampers 60 which can be positioned by use of their respective handles 64 which are attached to the dampers by shafts 62 so as to either block (as is shown in solid lines in FIG. 4) or leave unrestricted (as is shown in dotted lines in FIG. 4) the flow of air into such ducts from the outlet tubes 36 of particular dust separators. When the cooling tower is operating at a low percent of its capacity these dampers allow some of the dust separators to be shut off, increasing the air flow through those which remain in operation so that they will operate at proper efficiency.

It will be seen that I have accomplished the objects of my invention. I have provided a method of and apparatus for cooling lime which overcomes the defects of such cooling systems in the prior art. I have prevented the waste of heat by including dust separators within the cooling tower which is lined with insulating material 29, doing away with heat radiating external dust separators and the conduits that would lead to them. I have eliminated the problem of lime dust that settled on conduits leading to external dust separators. And I have greatly simplified the aggregating of the lime dust collected by dust separators with the other lime which has passed down through the cooling tower.

It will be understood that certain features and subcombinations are of utility and may be employed without reference to other features and subcombinations. This is contemplated by and is within the scope of my claims. It is further obvious that various changes may be made in details without departing from the spirit of my invention. It is, therefore, to be understood that my invention is not to be limited to the specific details shown and described.

Having thus described my invention, what I claim is:

1. Apparatus for cooling lime including in combination, a cooling chamber, means for introducing hot lime to be cooled into said chamber at a location below the top thereof, said cooling chamber having an outlet for cooling lime, means for introducing cooling air into said chamber, means for bringing said cooling air into direct heat exchange relationship with hot lime introduced into said inlet to cool the hot lime and to heat the cooling air, a dust separator having an inlet for receiving dust laden air, means mounting said separator within said chamber with said inlet thereof disposed above said location, means for directing heated air resulting from direct heat exchange into said dust separator inlet to produce clean heated air, and means for carrying said clean heated air away from said dust separator and away from said chamber.

2. Apparatus for cooling lime as in claim 1 in which said dust separator includes an outlet for the dust which it separates from said heated air, in which said separator is located generally above said cooling chamber outlet, and including a duct for guiding the fall of dust exiting said separator outlet into commingling relationship with cooled lime which has passed through said direct heat exchange means.

3. Apparatus for cooling lime as in claim 2 in which said duct guides said dust to the general vicinity of the outlet of the cooling chamber through which cooled lime passes.

4. Apparatus for cooling lime as in claim 1 in which said duct separator contains an inlet which is located adjacent to the top of said chamber.

5. Apparatus for cooling lime as in claim 4 in which said inlet in the cooling chamber into which hot lime is introduced is located near the top of said chamber, said apparatus including a partition means separating that part of the top portion of the cooling chamber in which the dust separator's air inlet is located from that part in which said hot lime inlet is located.

6. Apparatus for cooling lime as in claim 5 in which said partition means is made of thermally conductive material.

7. Apparatus for cooling lime as in claim 5 in which said partition has heat conducting fins attached to it.

8. Apparatus for cooling lime as in claim 1 in which said dust separator is of the cyclone type.

9. Apparatus for cooling lime as in claim 10 in which said duct guides and dust to the general vicinity of the outlet of the cooling chamber through which cooled lime passes.

10. Apparatus for cooling lime including in combination, a cooling chamber, means for introducing hot lime to be cooled into said chamber at a location below the top thereof, said cooling chamber having an outlet for cooled lime, means for introducing cooling air into said chamber, means for bringing said cooling air into direct heat exchange relationship with hot lime introduced into said inlet to cool the hot lime and to heat the cooling air, a dust separator having an inlet for receiving dust laden air and an outlet for dust separated from said dust laden air, means mounting said separator within said chamber with said inlet thereof disposed above said location, means for directing heated air resulting from direct heat exchange into said dust separator inlet to produce clean heated air, means for carrying said clean heated air away from said dust separator and away from said chamber, and a duct for guiding dust from said separator outlet to a location outside said chamber and into commingling relationship with cooled lime from said chamber outlet.

* * * * *